US005255579A

United States Patent [19]

Fortin

[11] Patent Number: 5,255,579

[45] Date of Patent: Oct. 26, 1993

[54] PIVOTING JAW LOCKING TOOL

[76] Inventor: Pierre Fortin, Ne. 33rd St., Pompano Beach, Fla. 33064

[21] Appl. No.: 932,917

[22] Filed: Aug. 20, 1992

Related U.S. Application Data

[63] Continuation-in-part of Ser. No. 643,514, Jan. 15, 1991, abandoned.

[51] Int. Cl.[5] ..... B25B 7/02

[52] U.S. Cl. ..... 81/424; 269/6; 81/421; 81/426.5

[58] Field of Search ..... 81/418, 421, 424, 426 .5; 269/6

[56] References Cited

U.S. PATENT DOCUMENTS

| | | | |
|---|---|---|---|
| 805,651 | 11/1905 | Lang | 81/424 |
| 2,882,768 | 4/1959 | Nelson | 81/424 X |
| 3,304,818 | 2/1967 | Heaton | 81/424 X |
| 3,779,108 | 12/1973 | Reiter | 81/424 |

*Primary Examiner*—James G. Smith
*Attorney, Agent, or Firm*—Malin, Haley, Dimaggio & Crosby

[57] ABSTRACT

A clamping device with a locking mechanism that is well known wherein the clamping jaws are modified so that they may be rotated around an axis extending between the clamping jaws. This allows opposing clamping jaws to be rotated to the side of the device thereby allowing clamping around corners and in crevice.

6 Claims, 7 Drawing Sheets

PIVOTING JAW LOCKING TOOL

This is a continuation-in-part of copending application(s) Ser. No. 07/643,514 filed on Jan. 15, 1991, now abandoned.

BACKGROUND OF THE INVENTION

1. Field of the Invention

This device relates generally to clamping devices with locking mechanisms and more particularly to vice locking clamping devices having pivoted opposing jaws.

2. Description of Related Art

Several clamping and locking mechanisms exist in the art. Exemplary of these are U.S. Pat. No. 2,280,005, issued Apr. 14, 1942 to W. Petersen and U.S. Pat. No. 2,514,130, issued Jul. 4, 1950 to H. T. Jones. These clamping devices are generally sold under the trademark VISE GRIP by the Petersen Manufacturing Co. of DeeWitt, Nebr.

Many devices incorporating variations in the configuration of the gripping jaws are present in the art. These prior art devices provide clamping jaws which perform specific functions or grip specific work pieces. Many of these clamping devices have pivoting jaws. However, none of these devices have jaws which pivot around an axis extending between the clamping jaws.

U.S. Pat. No. 4,747,588, issued May 31, 1988 to G. Dillhoff for a Universal Clamping Tool having rotating L-shaped clamping members, and U.S. Pat. No. 4,821,610, issued Apr. 18, 1989 to J. Redmon, Jr. et al. for swivel jaws on a Self-Locking Clamping Tool, show clamping devices having jaws which rotate around an axis passing through the jaws of the device. Clamping devices with locking mechanisms, particularly those of the vise locking variety, have proven to be extremely versatile and useful. Typically these devices have a pair of opposing clamping jaws attached each to its own handle, or arms, which arms are hinged together in scissor-like fashion. In the usual configuration, the clamping jaws extend forward from the arms so that the entire device presents an elongated clamping device which accesses the work piece to be clamped from the front of the device. Unfortunately, it is often necessary to clamp work pieces which may not be alignable with the front of these prior art clamping devices due to space limitations surrounding the work piece to be clamped. For example, it is often necessary to clamp work pieces which are located in crevices or chambers which are located to the side of where the elongated clamping device can be located. Therefore, work pieces located in such crevices are often inaccessible to prior art clamping devices because there is insufficient space to align the prior art devices with the work piece to be clamped.

In part in an attempt to remedy this problem, a variety of sizes of prior art clamping devices have been developed thereby allowing smaller clamping devices to have access to work pieces which wold be inaccessible to larger clamping devices. However, these smaller clamping devices often produce insufficient torque and/or clamping pressure due to their small size. Further, despite the small size of many of these smaller prior art clamping devices, there still exists a limitless variety of locations for work pieces which do not present themselves for clamping by the smaller prior art devices despite their small size. Therefore, in some applications requiring relatively large torque and/or clamping force, these smaller prior art devices prove incapable of either accessing the work piece or providing sufficient gripping strength to hold the work piece. For this reason, these smaller prior art clamping devices are often unacceptable.

It was in an attempt to address the problem of accessing work pieces located to the sides of an area where the main body of the clamping device can be placed that the instant invention was motivated.

SUMMARY OF THE INVENTION

The invention comprises a clamping device with a locking mechanism common in the art which has modified opposing clamping jaws. The opposing jaws are modified so that they may be rotated around an axis extending between the clamping jaws. This allows the opposing clamping jaws to be rotated to the side of the device thereby allowing clamping around corners and in crevices which had heretofore been inaccessible using prior art clamping devices. This pivoting arrangement allows the opposing jaws to rotate from their normal position directed forward in line with the main body of the clamping device to a position on either side of the device. These pivoting jaws may rotate from a position directed forward of the device until the jaws contact the body of the clamping device itself. In practice, it has been found that the opposing jaws may be rotated through an angle of more than 200 degrees, thereby providing clamping access to a wide variety of work piece locations.

Having thus briefly described the instant invention, a preferred embodiment will be described in detail with particular reference to the accompanying drawings where like elements are referred to by like numerals.

DETAILED DESCRIPTION OF THE INVENTION

Figure 1:
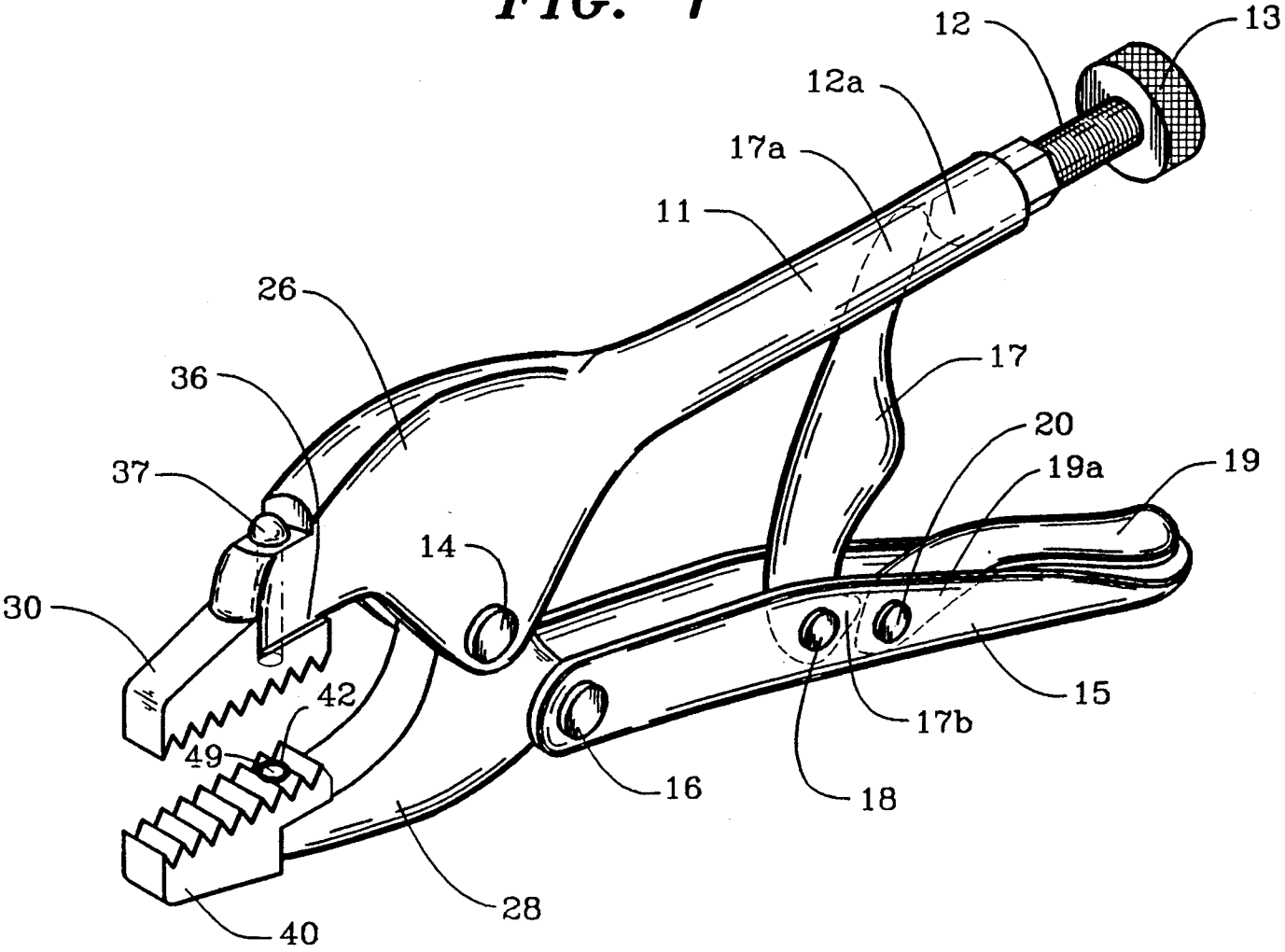
FIG. 1 is a perspective view of the invention.

Referring first to FIG. 1, the improved clamping device of the instant invention is shown generally by the reference numeral 10. Upper and lower pivoting jaws 30 and 40 are hingedly attached to a channel shaped fixed jaw 26 and a solid movable jaw 28, respectively. Fixed jaw 26 and movable jaw 28 are hingedly connected in scissor-like fashion and are part of a clamping tool 10 with a locking mechanism which is well known in the art and which will be briefly described hereafter. The opposing work piece engagement surfaces 30' and 40' of upper and lower pivoting jaws 30 and 40, respectively, may be of any shape, including planar, serrated, or arcuate to name but a few.

Figure 2:
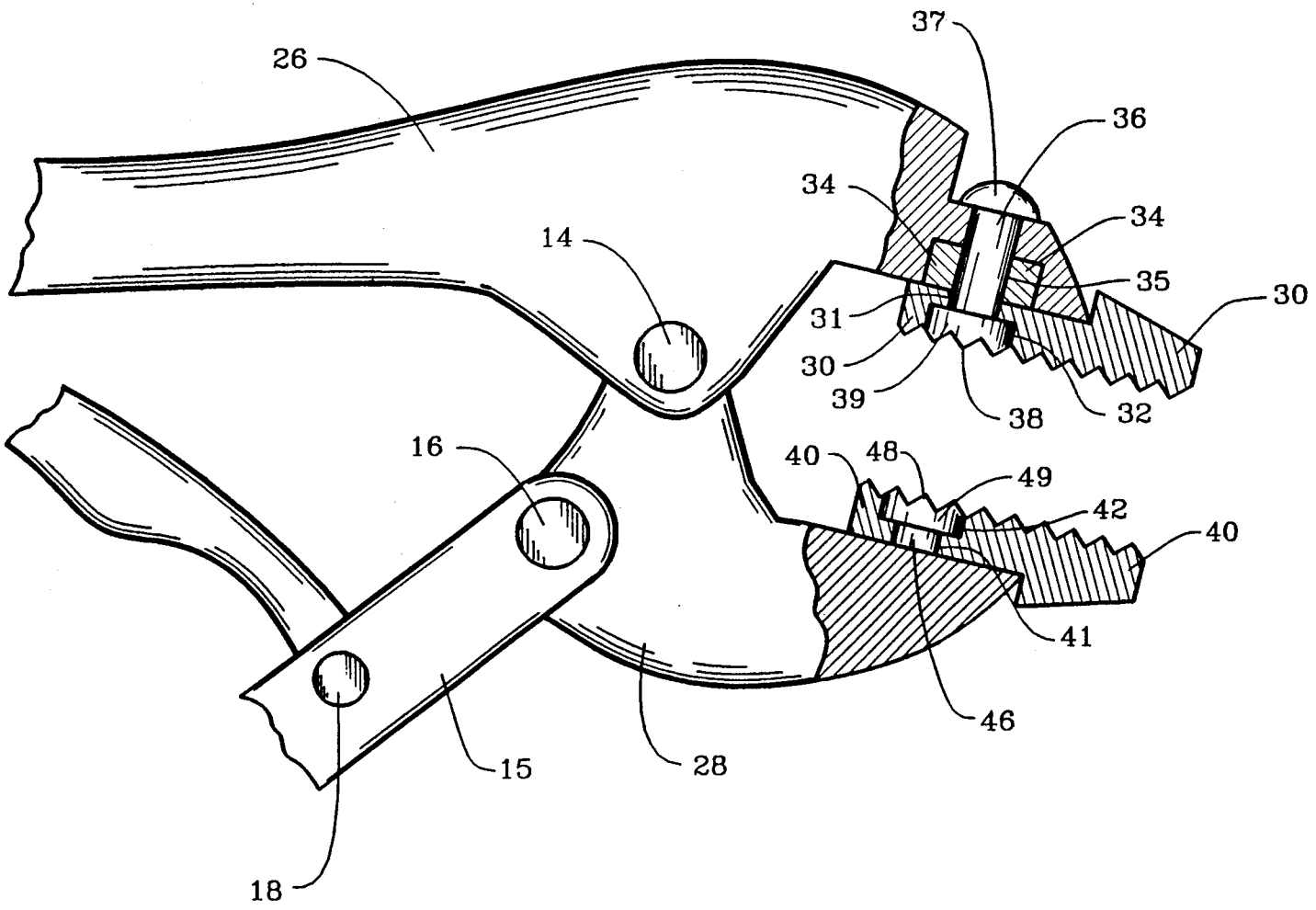
FIG. 2 is a side cross-sectional partial view of the invention of FIG. 1.

As shown in FIG. 2, an upper pivot plate 34 is attached to the lower surface of fixed jaw 26 between fixed jaw 26 and upper pivoting jaw 30. Upper pivot plate 34 is preferably attached to fixed jaw 26 by gas metal arc welding (GMAW) or metal inert gas (MIG) welding. A pivot plate aperture 35 extends entirely through upper pivot plate 34, normal to the surface of upper pivot plate 34.

Pivot jaw aperture 31 extends through upper pivot jaw 30 and is aligned with pivot plate aperture 35. Pivot jaw aperture 31 ends in an outwardly flared opening 32. An upper pivot pin 36 having an expanded head 37 within fixed jaw 26, extends from within fixed jaw 26, which is generally channel-shaped, through pivot plate aperture 35 and pivot jaw aperture 31 into flared opening 32. Head 37 holds upper pivot pin 36 in place within the inner channel area of fixed jaw 26.

The end 38 of upper pivot pin 36 extending into flared opening 32 is outwardly deformable by compression so as to provide a cap 39 on the end 38 of upper pivot pin 36 to hold upper pivot jaw 30 in contact with upper pivot plate 34. Cap 39 holds upper pivot jaw 30 in frictional contact with upper pivot plate 34 thereby allowing movement of upper pivot jaw 30 around upper pivot pin 36 but constraining such movement from freely occurring.

Movable jaw 28, as is common in clamping tools with locking mechanisms, is preferably a solid planar piece, unlike the channel shaped fixed jaw 26. Therefore, no pivot plate is required to attach lower pivoting jaw 40 to movable jaw 28 as was required to attach upper pivoting jaw 30 to fixed jaw 26. Instead a lower pivot pin 46 is attached to movable jaw 28 by mean such as welding as described above. Lower pivot pin 46 extends upward from movable jaw 28. Lower pivoting jaw 40 has an aperture 41 of corresponding diameter to lower pivot pin 46 which ends in a flared opening 42. Lower pivot post 42 is placed through aperture 41 and flared opening 42 so that lower pivoting jaw 40 is brought into contact with movable jaw 28.

Lower pivot pin 46 is deformable at end 48 in like fashion to end 38 of upper pivot pin 36 so as to form a cap 49. After lower pivot pin 46 has been passed through aperture 41 and flared opening 42, end 48 of lower pivot pin 46 is deformed outwardly by compression to form cap 49. Cap 49 binds lower pivoting jaw 40 to movable jaw 28 and restrain its movement. In this way, lower pivoting jaw 40 may pivot around lower pivot pin 46 but is constrained from freely pivoting by the friction present between lower pivoting jaw 40 and movable jaw 28.

The formation of caps 39, 49 by outward deformation of ends 38, 48 of upper pivot pin 36 and lower pivot pin 46 respectively is done by pressing a convex-shaped protrusion into the ends 38, 48 by processes commonly used in the art to deform the ends of rivets.

Although caps 39, 49 have been described as being created by the deformation of ends 38, 48, other types of caps 39, 49 are within the scope of the invention. For example, caps 39, 49 may be formed by tack welding or pressing a metal disk onto ends 38, 48. These alternate descriptions of cap 39, 49 are given as exemplary and not for limitation. The important characteristic of cap 39, 49 being that cap 39, 49 restrains upper and lower pivoting jaws 30, 40 around upper and lower pivot pins 36, 46.

As stated above, the clamping and locking mechanism is well known in the art. Therefore, a brief description of its operation will be given. The actuating handles and locking mechanism are well understood in the art in connection with hand tools generally referred to as locking pliers wrenches, such as those described in U.S. Pat. No. 2,280,005 issued Apr. 14, 1942 to W. Petersen and U.S. Pat. No. 2,514,130 issued Jul. 4, 1950 to H. T. Jones, and generally sold under the trademark VISE GRIP by the Petersen Manufacturing Co. of DeWitt, Nebr. Such a tool has been used in the embodiment of FIG. 1 by adding upper and lower pivoting jaws 30, 40 and their associated upper pivot plate 34 and pivot pin 36, and pivot pin 46 respectively. Since the operation of the locking pliers wrench tool is well understood, it Will only be briefly described.

Turning to FIG. 1, the channel-like fixed jaw 26 is integrally attached to an upwardly directed elongated channel-like fixed handle 11, having an outer surface adapted to be easily grasped by the hand. The upper end of fixed handle 11 contains an interiorly threaded sleeve which threadedly accepts a threaded shank 12 terminating at its upper end in a thumb screw 13. The lowermost end of threaded shank 12 terminates in a head **12*a*, as is well known in the art. The solid movable jaw 28 is pivotally mounted to the lowermost end of fixed handle 11 by means of rivet 14**, or the like.

Positioned toward the rear of movable jaw 28 is an upwardly directed channel-like lever 15 which acts as an operating handle. The lowermost end of operating handle 15 is pivotally attached to movable jaw 28 by means of rivet 16 or the like.

A stud lever or fulcrum bar 17 of the desired length extends between the side walls of operating handle 15, and is pivotally attached thereto by means of rivet 18 or the like. The other end **17*a* of fulcrum bar 17 abuts the lowermost head end of threaded shank 12**, as is well understood in the art.

In operation, when fixed handle 11 and movable handle 15 are squeezed together so as to draw movable hand 15 toward fixed handle 11, fixed and movable jaws 26, 28 rotate inwardly to bring upper and lower pivoting jaws 30, 40 into abutting contact. At the same time, fulcrum bar end **17*a* slides upwardly within channel-like fixed hand 11 into abutting contact with the head end 12*a* of threaded shank 12 placing fulcrum bar 17 in compression, and thereby tending to lock the fixed and operating handles together as a result of the downward pressure exerted against rivet 18, which is transmitted through the lower portion of movable hand 15 to movable jaw 28. As is well understood, the mechanical advantage provided by this type of locking mechanism is considerable, and tends to retain upper and lower pivoting jaws 30, 40 in the clamped position against adjoining surfaces of a work piece (not shown) until handles 11 and 15 are manually separated to release the compression forces in fulcrum bar 17**.

To facilitate the release of this locking mechanism and the separation of handles 11 and 15, a releasing lever 19 is provided of generally U-shaped cross section which easily fits within movable handle 15 and is kept in place by a transversely extending pin 20 secured to the side walls of handle 15, which also permits relative pivotal movement between releasing lever 19 and handle 15. The lowermost end 19*a* of releasing lever 19 is adapted to pivot or fulcrum against an upstanding rib 18*b* positioned on the edge of the fulcrum bar 17 adjacent movable handle 18 when the uppermost end of releasing lever 19 is lifted or pulled toward movable handle 18, thus permitting handles 11 and 18 to be separated to disengage upper and lower pivoting jaws 30, 40 from their clamping position.

Figure 3:
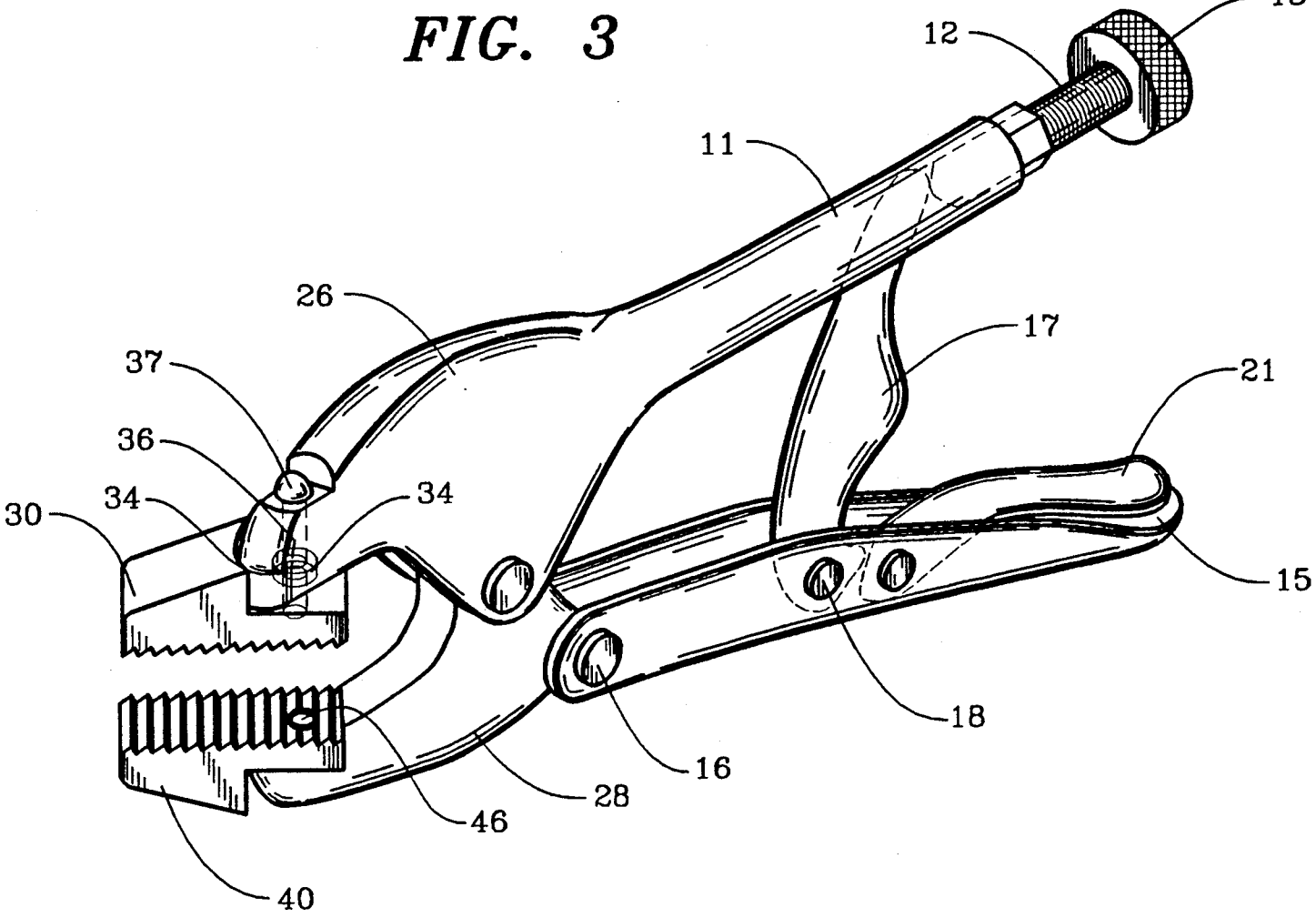
FIG. 3 is a perspective view of the first embodiment of the present invention having its jaws pivoted to the right.

An alternative construction for the releasing lever is shown in connection with the embodiment of FIG. 3, which depicts the type of locking plier wrench operating mechanism distributed by Sears, Roebuck & Co. In this arrangement, a releasing lever 21 of generally U-shaped cross section adapted to easily fit within movable handle 15, is pivotally attached to fulcrum bar 17 at approximately its midpoint, by means of rivet 22 or the like. The lowermost end of releasing lever 21 is adapted to pivot or fulcrum against movable handle 15 at a point between pivotal connection 18 and pivotal connection 16 when releasing lever is lifted or pulled away from movable handle 15, thereby moving the uppermost end of fulcrum bar 17 downwardly along the interior channel or fixed handle 11 to separate handles 11 and 15 and thus disengage upper and lower pivoting jaws 30, 40 from their clamped position.

All of the embodiments described heretofore include a fixed handle 11 which is provided with a threaded shank 12 which may be longitudinally moved within handle ;1 by rotating thumb screw 13 to control the length of travel of the upper end of fulcrum bar 17, thereby adjusting the separation between upper and lower pivoting jaws 30, 40 to provide for differently sized work pieces, as is well understood in the art.

To use the invention, a release lever 19 (FIG. 1) or 21 (FIG. 3) is released, thereby allowing handles 11 and 15 to be separated. The separation of handles 11 and 15 separates upper and lower pivoting jaws 30, 40. At this time, upper and lower pivoting jaws 30, 40 may be pivoted around upper and lower pivot pins 36, 46, respectively, so that upper and lower pivoting jaws 30, 40 may be aligned with the work piece to be grasped therebetween. Because of the frictional contact between upper pivoting jaw 30 and fixed jaw 26 and lower pivoting jaw 40 and movable jaw 28, respectively, upper and lower pivoting jaws 30, 40 are held in the desired alignment relative to the body of the device. This frictional contact between upper pivoting jaw 30 and fixed jaw 26 and lower pivoting jaw 40 and movable jaw 28, respectively, is due to the deformation of ends 38, 48 of upper and lower pivot pins 36, 46 respectively, which deformations seats itself against upper and lower pivoting jaws 30, 40 within flared openings 32, 42 respectively.

It will thus be apparent that the tool of the embodiments of FIGS. 1–3 permits a work piece to be grasped at an angle to the main body of the device and to be securely clamped with singlehanded operation by a workman. In addition, when it is desired to release the work piece, the tool may be easily removed, again requiring only a single hand to actuate the releasing or unlocking mechanism.

Figure 5A:
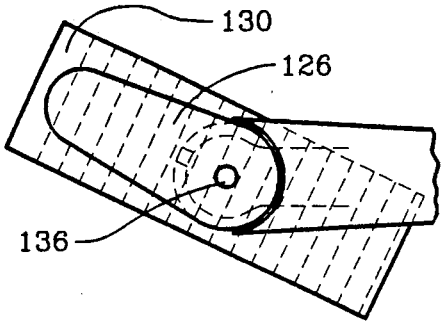
FIG. 5A is a top view of the invention shown in FIG. 5 having its jaws pivoted to the right.
Figure 5B:
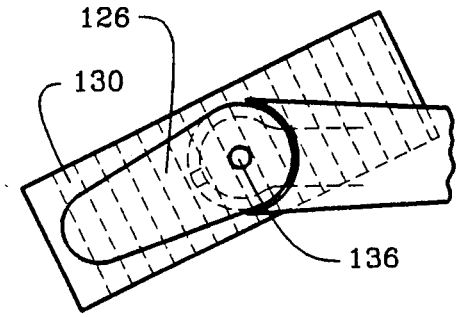
FIG. 5B is a top view of the invention shown in FIG. 5 having its jaws pivoted to the left.
Figure 3A:
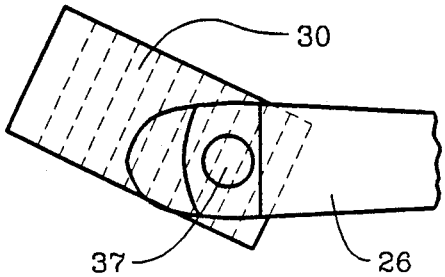
FIG. 3A is a top view of the invention shown in FIG. 3 having its jaws pivoted to the right.
Figure 3B:
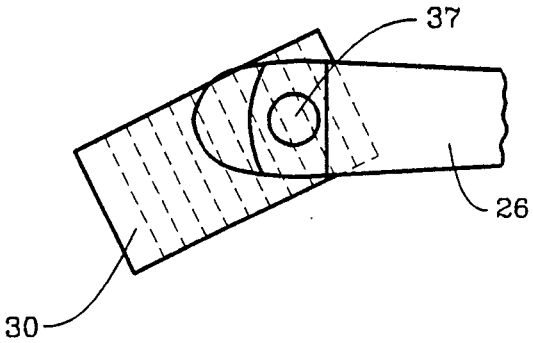
FIG. 3B is a top view of the invention shown in FIG. 3 having its jaws pivoted to the left.
Figure 4A:
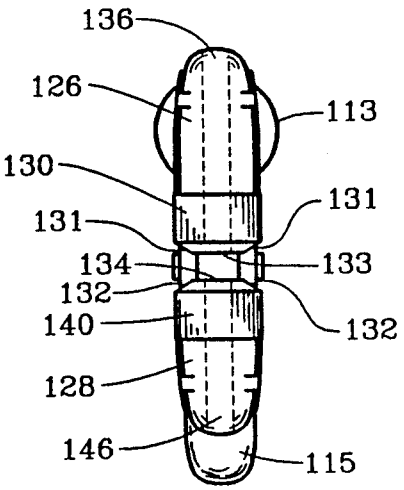
FIG. 4A is a front view of the invention shown in FIG. 4.
Figure 4:
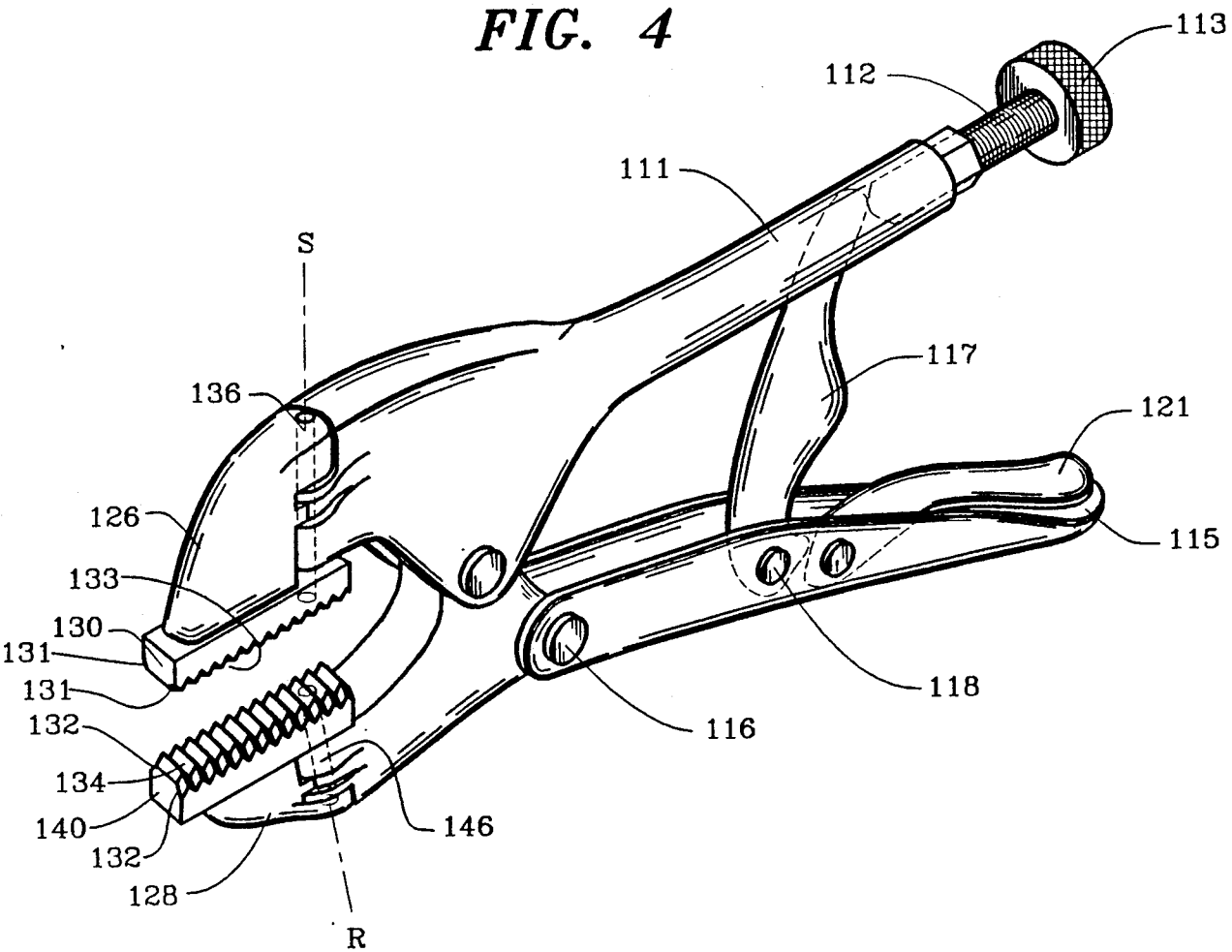
FIG. 4 is a perspective view of a second embodiment of the instant invention having beveled jaw surfaces.
Figure 5:
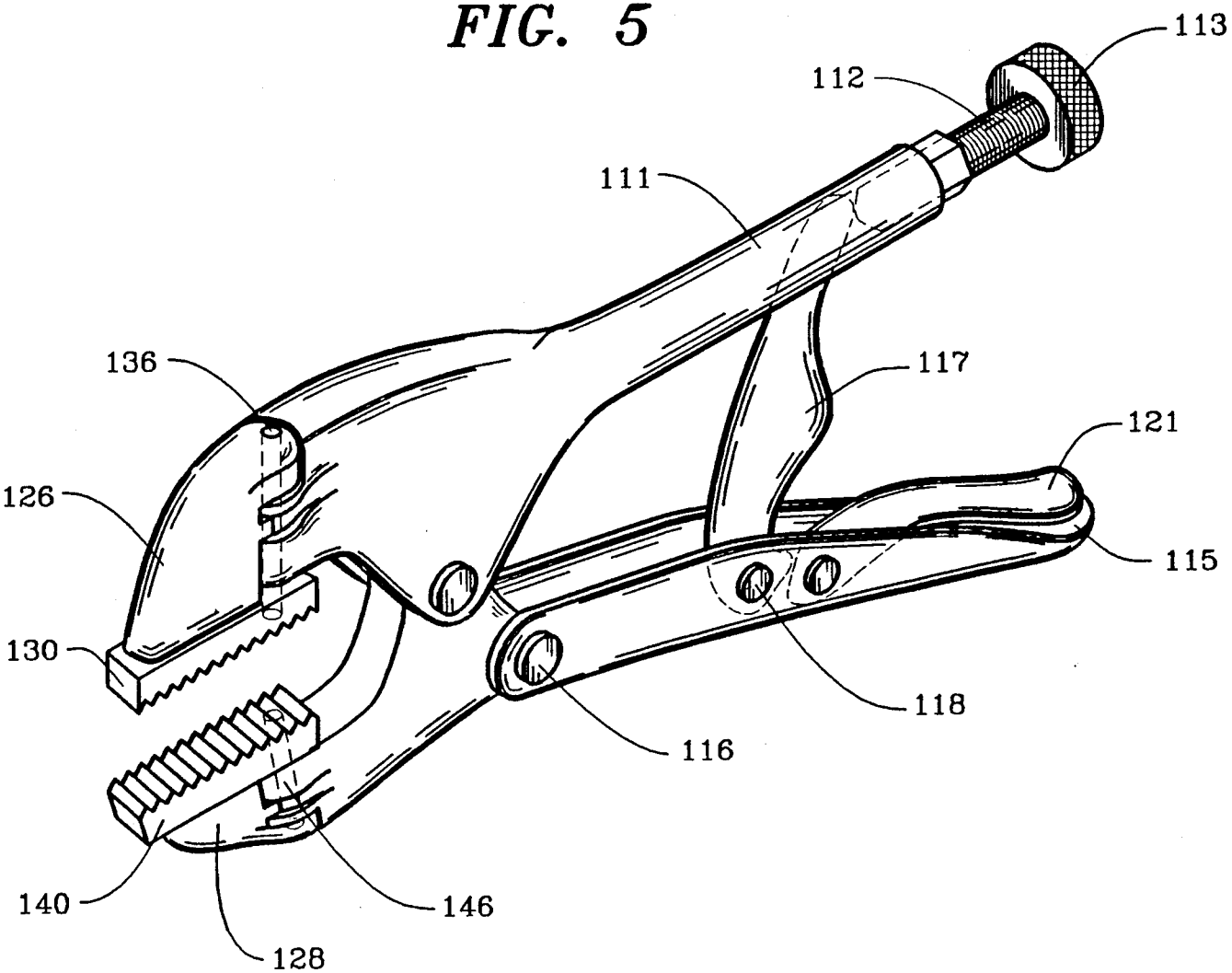
FIG. 5 is a perspective view of the second embodiment of the instant invention.

FIGS. 4 through 5B illustrate a second embodiment wherein pins 136 and 146 are located closer to handle 111 on jaw 126 and movable jaw 128, respectively, to permit jaw 126 and movable jaw 128 to pivot with the pivoting of upper pivot jaw 130 and lower pivot jaw 140. Alternatively, pins 136 and 146 an be located in the same position as the first embodiment and the length of jaw 126 and movable jaw 128 is extended to allow a portion of jaws 126 and 128 to pivot along with jaws 130 an 140, respectively. Jaws 126 and 130 can be constructed either as two separate pieces or one single piece. Likewise, jaws 128 and 140 can be constructed either as two separate pieces or one single piece. In this embodiment, additional support is provided to jaws 130 and 140 since jaws 130 and 140 abut jaws 126 and 128, respectively. The clamping and locking mechanism operates the same and is similar to the clamping mechanism shown in FIG. 1.

Figure 6A:
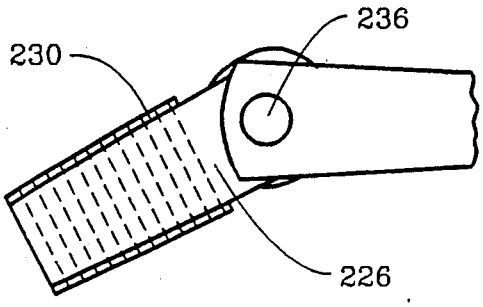
FIG. 6A is a top view of the invention shown in FIG. 6 having its jaws pivoted to the left.
Figure 6B:
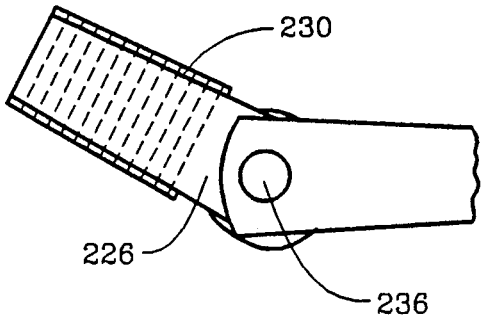
FIG. 6B is a top view of the invention shown in FIG. 6 having its jaws pivoted to the right.
Figure 6:
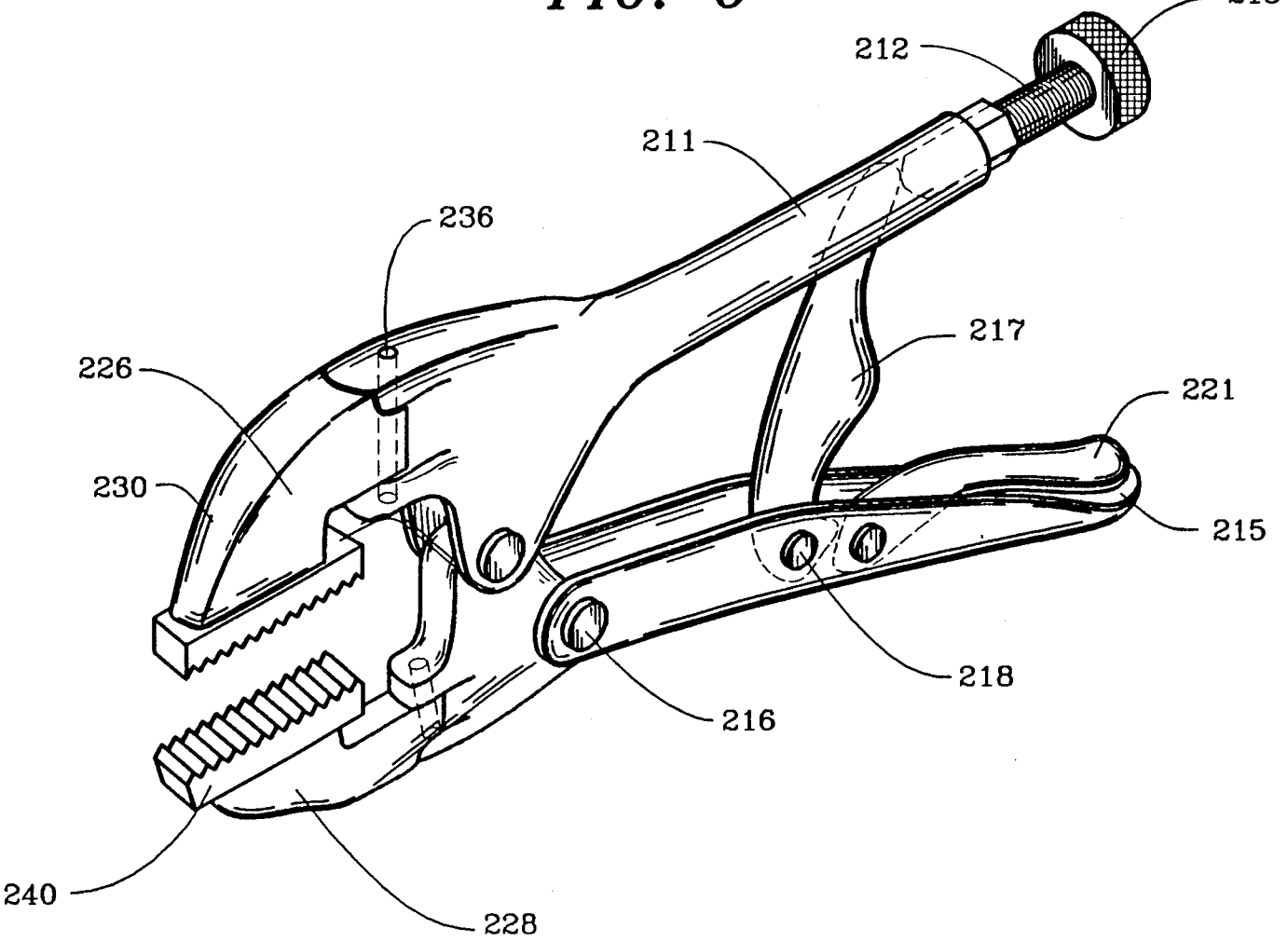
FIG. 6 is a perspective view of a third embodiment of the present invention.

FIGS. 6 through 6B illustrate a third embodiment wherein pins 236 and 246 are located even closer to handle 211 on jaw 226 and movable jaw 228, respectively, to provide jaw 226 and movable jaw 228 with a longer reach when jaws 226 and 228 are pivoted with the pivot of about upper pivot jaw 230 and lower pivot jaw 240. Jaws 226 and 230 can be constructed either as two separate pieces or one single piece. Likewise, jaws 228 and 240 can be constructed either as two separate pieces or one single piece. In this embodiment, further support form the second embodiment is provided to jaws 230 and 240 since jaws 230 and 240 are abutting, at a larger area, jaws 226 and 228, respectively. The clamping and locking mechanism operates the same and is similar to the clamping mechanism shown in FIG. 1.

FIG. 4 illustrates an alternative embodiment for jaws 130 an 140 wherein the jaws are shown having beveled sides 131 and 132. The beveled jaws can be employed with any of the three embodiments discussed above. Turning adjusting bolt 113 changes the position of the pins 136 and 146 with respect to one another, thus changing the orientation of the axes of rotation of the respective jaws. Such repositioning is commonly required to change the spacing between gripping jaws 130 and 140 to accommodate different sized workpieces such as nut or bolt heads, and causes the planes in which the respective upper and lower gripping surfaces 130 and 140 lie move with respect to one another for any given position of fixed handle 111. This causes the axes of rotation S and R of the jaws to no longer be parallel. Beveled sides 131 and 132 overcome this problem by rendering a portion of the gripping surfaces of the respective jaws 130 and 140 to remain parallel, or close to parallel, to one another to increase the surface area available to contact a workpiece. Beveled sides surfaces 131 and 132 preferably having serrations extending along their respective lengths.

The instant invention has been described in connection with specific embodiments. It is to be understood that the descriptions given herein are exemplary and not intended to be limited only to the specific structure disclosed. It is clear that changes and modifications to the descriptions given may be made and still be within the scope of the invention. Further, obvious changes and modifications will occur to those skilled in the art.

What I claim is:

1. A clamping tool having a handle portion in association with a locking mechanism, said clamping tool producing a clamping force between an opposing first and second jaw, said first and second jaws pivotally connected whereby said first and second jaws may be moved between an opened and a clamped position, the improvement comprising:

(a) an upper pivoting work contacting member for contacting a work piece, said upper pivoting work contacting member having an upper gripping surface, said upper pivoting work contacting member pivotally and securely attached to said first jaw along an axis between said first and second jaws; and (b) a lower pivoting work contacting member for contacting said work piece, said lower pivoting contacting member having a lower gripping surface, said lower pivoting work contacting member pivotally and securely attached to said second jaw along said axis between said first and second jaws;

wherein planes in which said upper and lower gripping surfaces lie can be moved relative to one another when in said open position;

whereby said upper and lower pivoting jaws may be pivoted around said axis between said first and second jaws into alignment with said work piece to be clamped between said upper and lower pivoting work contacting members;

wherein said upper pivoting work contacting member and said lower pivoting contacting member having beveled side gripping surfaces, said beveled side gripping surfaces having serrations.

2. The clamping tool of claim 1 wherein said first jaw and said second jaw pivot with the pivoting of said upper pivoting work contacting member and said lower pivoting work contacting member, respectively.

3. A clamping tool having a handle portion in association with a locking mechanism, said clamping tool producing a clamping force between an opposing first and second jaw, said first and second jaws pivotally connected whereby said first and second jaws may be moved between an opened and a clamped position, the improvement comprising:

(a) an upper pivoting work contacting member pivotally attached to said first jaw, said upper pivoting work contacting member having an upper gripping surface, said upper pivoting work contacting member having an upper aperture extending therethrough perpendicular to the point of attachment of said first jaw to said upper pivoting work contacting member;

(b) a lower pivoting work contacting member pivotally attached to said second jaw, said lower pivoting work contacting member having a lower gripping surface, said lower pivoting work contacting member having a lower aperture extending therethrough perpendicular to the point of attachment of said second jaw to said lower pivoting work contacting member;

(c) an upper pivot pin having a first end and a second end, said first end attached to said first jaw and said second end extending downward through said first aperture in said upper pivoting work contacting member;

(d) a lower pivot pin having a first end and a second end, said first end attached to said second jaw and said second end extending upward through said second aperture in said lower pivoting work contacting member;

(e) means for retaining said second end of said upper pivot pin within said upper aperture so that said upper pivoting work contacting member may rotate about said upper pivot pin; and (f) means for retaining said second end of said lower pivot pin within said lower aperture so that said lower pivoting work contacting member may rotate about said lower pivot pin;

wherein planes in which said upper and lower gripping surfaces lie can be moved relative to one another when in said open position;

whereby said upper pivoting work contacting member may rotate about said upper pivot pin and said lower work contacting member may rotate about said lower pivot pin;

wherein said upper pivoting work contacting member and said lower pivoting contacting member having beveled side gripping surfaces, said beveled side gripping surfaces having serrations.

4. The clamping tool of claim 3 wherein said first jaw and said second jaw pivot with the pivoting of said upper pivoting work contacting member and said lower pivoting work contacting member, respectively.

5. A clamping tool having a handle portion in association with a locking mechanism, said clamping tool producing a clamping force between an opposing first and second jaw, said first and second jaws pivotally connected whereby said first and second jaws may be moved between an opened and a clamped position, the improvement comprising:

(a) an upper pivoting work contacting member pivotally attached to said first jaw, said upper pivoting work contacting member having an upper gripping surface, said upper pivoting work contacting member having an upper aperture extending therethrough perpendicular to the point of attachment of said first jaw to said upper pivoting work contacting member;

(b) a lower pivoting work contacting member pivotally attached to said second jaw, said lower pivoting work contacting member having a lower gripping surface, said lower pivoting work contacting member having a lower aperture extending therethrough perpendicular to the point of attachment of said second jaw to said lower pivoting work contacting member;

wherein said upper and said lower apertures end in an expanded opening on their respective ends opposite their closest approach to respective first and second jaws, said expanded openings for containing said means for retaining said respective second ends of said respective upper and lower pivot pins;

wherein planes in which said upper and lower gripping surfaces lie can be moved relative to one another when is said open position;

(c) an upper pivot pin having a first end and a second end, said first end attached to said first jaw and said second end extending downward through said first aperture in said upper pivoting work contacting member;

(d) a lower pivot pin having a first end and a second end, said first end attached to said second jaw and said second end extending upward through said second aperture in said lower pivoting work contacting member;

(e) means for retaining said second end of said upper pivot pin within said upper aperture comprising a first cap attached to said second end of said upper pivot pin, said first cap having a diameter larger that the diameter of said first aperture whereby said first cap retains said upper pivoting work contacting member about said upper pivot pin, so that said upper pivoting work contacting member may rotate about said upper pivot pin; and, (f) means for retaining said second end of said lower pivot pin within said lower aperture comprising a second cap attached to said second end of said lower pivot pin, said second cap having a diameter larger than the diameter of said second aperture whereby said second cap retains said lower pivoting work contacting member about said lower pivot pin so that said lower pivoting work contacting member may rotate about said lower pivot pin;

wherein said upper pivoting work contacting member and said lower pivoting contacting member having beveled side gripping surfaces, said beveled side gripping surfaces having serrations.

6. The clamping tool of claim 5 wherein said first jaw and said second jaw pivot with the pivoting of said upper pivoting work contacting member and said lower pivoting work contacting member, respectively.

* * * * *